US008294629B2

(12) United States Patent
Yosui et al.

(10) Patent No.: US 8,294,629 B2
(45) Date of Patent: Oct. 23, 2012

(54) MAGNETIC ANTENNA AND ANTENNA DEVICE

(75) Inventors: Kuniaki Yosui, Kanazawa (JP); Hiroyuki Kubo, Kanazawa (JP); Hiromitsu Ito, Hakusan (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 323 days.

(21) Appl. No.: 12/507,272

(22) Filed: Jul. 22, 2009

(65) Prior Publication Data

US 2010/0053014 A1 Mar. 4, 2010

(30) Foreign Application Priority Data

Aug. 29, 2008 (JP) ..... 2008-220739

(51) Int. Cl.
*H01Q 7/08* (2006.01)

(52) U.S. Cl. ..... 343/788; 343/895

(58) Field of Classification Search ..... 343/788, 343/895

See application file for complete search history.

(56) References Cited

U.S. PATENT DOCUMENTS

| | | | |
|---|---|---|---|
| 2007/0247387 | A1 | 10/2007 | Kubo et al. |
| 2008/0007473 | A1 | 1/2008 | Yosui et al. |
| 2009/0096694 | A1 | 4/2009 | Ito et al. |

FOREIGN PATENT DOCUMENTS

| | | | | |
|---|---|---|---|---|
| JP | 2003-022912 | A | | 1/2003 |
| JP | 2005-318329 | A | | 11/2005 |
| JP | 2005-333244 | A | | 12/2005 |
| JP | 3772778 | B2 | | 5/2006 |
| JP | 2008-035459 | A | | 2/2008 |
| JP | 2008-035464 | A | | 2/2008 |
| JP | 2008-048376 | A | | 2/2008 |
| JP | 2008028642 | A | * | 2/2008 |

OTHER PUBLICATIONS

Official Communication issued in corresponding Japanese Patent Application No. 2008-220739, mailed on Nov. 29, 2011.

* cited by examiner

*Primary Examiner* — Dieu H Duong
(74) *Attorney, Agent, or Firm* — Keating & Bennett, LLP

(57) ABSTRACT

A highly sensitive magnetic antenna and an antenna device achieve strong coupling with magnetic flux substantially perpendicular to main surfaces of a magnetic core, an enlarged antenna opening, and increased efficiency of magnetic flux radiation. The magnetic antenna includes a flexible substrate and a magnetic core preferably having a substantially rectangular plate shape. The flexible substrate has a spiral coil conductor located thereon, and the coil conductor has a conductor opening located at the center of the winding center thereof. The flexible substrate is bent in the vicinity of the two sides of the coil conductor spaced apart from the center of the conductor opening and along the two sides of the magnetic core, so as to wrap around the upper surface, left and right surfaces, and portions of the lower surface of the magnetic core.

3 Claims, 7 Drawing Sheets

MAGNETIC ANTENNA AND ANTENNA DEVICE

BACKGROUND OF THE INVENTION

1. Field of the Invention

The present invention relates to a magnetic antenna and an antenna device for use in, for example, a radio frequency identification (RFID) system that communicates with external apparatuses via an electromagnetic signal.

2. Description of the Related Art

In RFID systems, which have been increasingly used in recent years, data communication is performed between a mobile electronic apparatus, such as a cellular phone, and a reader/writer each provided with an antenna for information communication. Regarding the antenna provided in a mobile electronic apparatus, in particular, there is strong demand for increased performance and reduced price and size. In response to this demand, a magnetic antenna having a magnetic core disclosed in Japanese Patent No. 3772778 has been developed.

FIG. 1 is a perspective view of the magnetic antenna shown in Japanese Patent No. 3772778. An antenna 10 includes a magnetic core member (magnetic core) 12 and a single electric insulator film (flexible substrate) 14 which has a spiral portion 13*a* made up of a series of first conductors 13 (coil conductors) formed on one main surface thereof. The other main surface of the electric insulator film 14 has a second conductor 15 formed thereon, and an end of the second conductor 15 and an end of the first conductor 13 are connected to an IC chip 16.

However, since the structure shown in Japanese Patent No. 3772778 is a structure in which the flexible substrate is folded at the center so as to sandwich a magnetic core, basically, the antenna only is only coupled by magnetic flux that comes from a direction substantially parallel with the main surfaces of the magnetic core. Hence, magnetic flux coming from a direction substantially perpendicular to the main surfaces of the magnetic core is not able to pass through the loop plane of the coil conductor from one side to the other side, thereby causing very weak coupling.

Further, the opening of the antenna becomes smaller since portions of the coil conductor occupy part of the surface of the magnetic core, through which magnetic flux passes. This also causes the coupling to become weaker.

SUMMARY OF THE INVENTION

In view of the above, preferred embodiments of the present invention provide a highly sensitive magnetic antenna and an antenna device having strong coupling with magnetic flux substantially perpendicular to the main surfaces of the magnetic core, an enlarged antenna opening, and increased efficiency of magnetic flux radiation.

A magnetic antenna according to a preferred embodiment of the present invention includes a magnetic core, a flexible substrate arranged to wrap around the magnetic core along a surface thereof, and a coil conductor on the flexible substrate. The magnetic core preferably has a plate-shaped configuration having at least two substantially parallel sides. The coil conductor preferably has a substantially rectangular spiral shape having at least two substantially parallel sides and a conductor opening located at a winding center of the coil conductor. The flexible substrate is bent in the vicinity of the two sides of the coil conductor spaced apart from the center of the conductor opening and along the two sides of the magnetic core.

By using this structure, magnetic flux passing through the magnetic core in a direction substantially perpendicular to the main surfaces thereof passes through the inside of the coil loop of the spiral coil conductor, resulting in strong coupling with the magnetic flux. Since the two sides of the coil conductor are arranged near the two sides of the magnetic core, the coil conductor does not occupy considerable or significant portions of the magnetic-flux-passing surface of the magnetic core, thus ensuring a wide opening area of the antenna. This results in increases in the magnetic flux radiation efficiency, antenna sensitivity, and communication range.

The coil conductor may preferably include two connected substantially rectangular spiral coil conductors.

This allows the antenna to be designed so as to support a wide range of impedance by appropriately selecting the method (serial/parallel) used to connect the two coil conductors.

The two substantially rectangular spiral coil conductors may preferably have opposite winding directions and be serially connected to each other.

By using this structure, the connection pattern of the two coil conductors becomes simple, and no insulation between wiring lines is required. Further, there is no need to serially connect the two coil conductors on a circuit substrate on which they are mounted.

An antenna device according to another preferred embodiment of the present preferred embodiment includes the magnetic antenna according to any one the preferred embodiments described above and a plate member having a sheet-shaped conductor (for example, a substrate or LCD shield plate) provided in the vicinity of the magnetic antenna.

Consequently, magnetic flux is generated that passes through the magnetic core from a certain surface to another surface thereof. Since this flux passes through the inside of the coil loop of the coil conductor, the effective antenna opening is widened and hence a highly sensitive antenna device is provided.

A magnetic antenna according to various preferred embodiments of the present preferred embodiment achieves strong coupling with magnetic flux that is substantially perpendicular to the main surfaces of a magnetic core. Consequently, the effective antenna opening and radiation efficiency of magnetic flux are significantly increased. As a result, when the antenna is applied to an RFID system, the communication range is increased.

Other features, elements, arrangements, steps, characteristics and advantages of the present invention will become more apparent from the following detailed description of preferred embodiments of the present invention with reference to the attached drawings.

BRIEF DESCRIPTION OF THE DRAWINGS

FIGS. 2A to 2C illustrate a structure of a magnetic antenna according to a first preferred embodiment of the present invention; wherein FIG. 2A is a perspective view of a flexible substrate, in a developed state, used in the magnetic antenna; FIG. 2B is a perspective view of a magnetic core and the flexible substrate, in a folded state, used in the magnetic antenna; and FIG. 2C is a perspective view of the magnetic antenna.

FIGS. 3A and 3B illustrate a structure of a magnetic antenna and an antenna device according to a second preferred embodiment of the present invention; wherein FIG. 3A is a perspective view of the antenna device, and FIG. 3B is a diagram illustrating a current that flows in the coil conductor of the magnetic antenna and magnetic flux that passes through the magnetic core.

FIGS. 5A to 5C illustrate a structure of a magnetic antenna according to a third preferred embodiment of the present preferred embodiment; wherein FIG. 5A is a developed view of a flexible substrate used in the magnetic antenna, FIG. 5B is a perspective view of a magnetic core included in the magnetic antenna, FIG. 5C is a perspective view of the magnetic antenna.

FIGS. 6A and 6B illustrate structures of two magnetic antennas according to a fourth preferred embodiment of the present preferred embodiment, wherein FIG. 6A shows a perspective view and an exploded perspective view of a magnetic antenna, FIG. 6B shows a perspective view and an exploded perspective view of a magnetic antenna.

FIGS. 7A and 7B illustrate a structure of a magnetic antenna, wherein FIG. 7A is a perspective view of a flexible substrate, in a developed state, used in the magnetic antenna, and FIG. 7B is a perspective view of the magnetic antenna.

DETAILED DESCRIPTION OF THE PREFERRED EMBODIMENTS

First Preferred Embodiment

Figure 1:
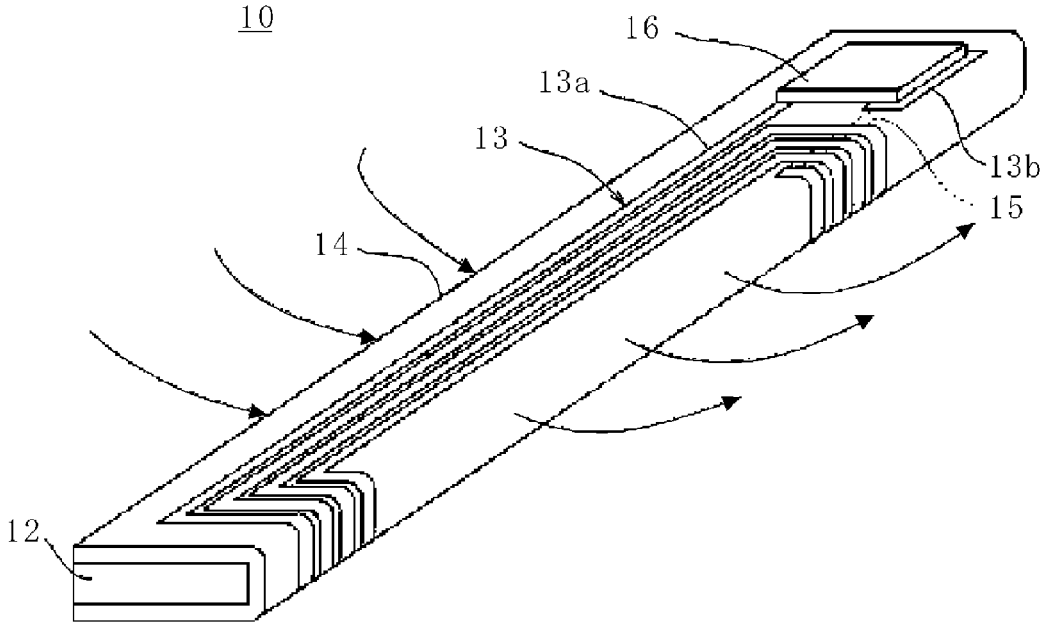
FIG. 1 Prior Art
FIG. 1 is a perspective view of a magnetic antenna shown in Japanese Patent No. 3772778.
Figure 2A:
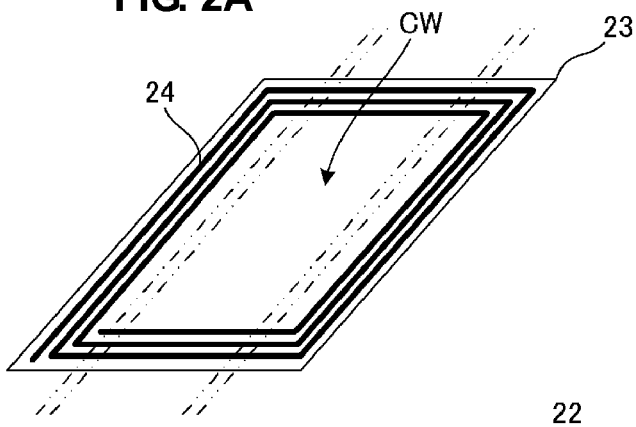
Figure 2B:
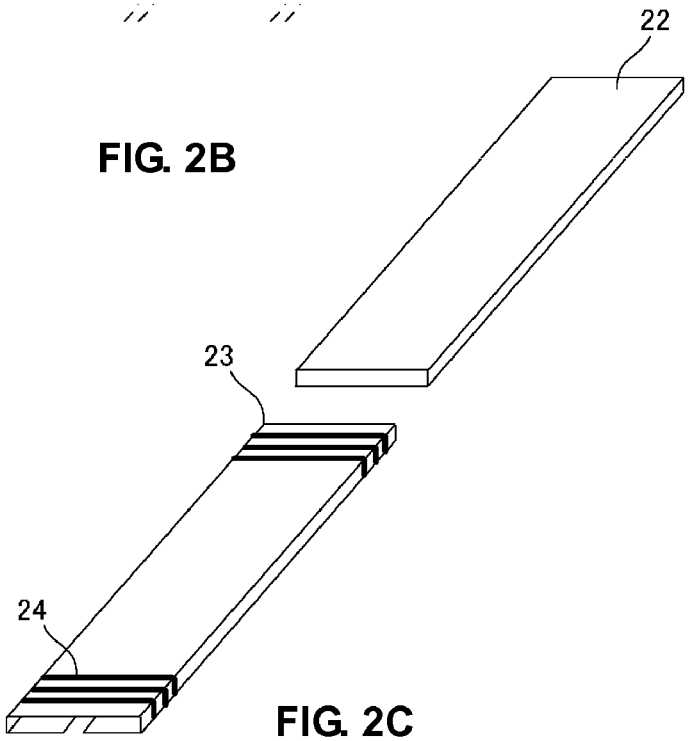
Figure 2C:
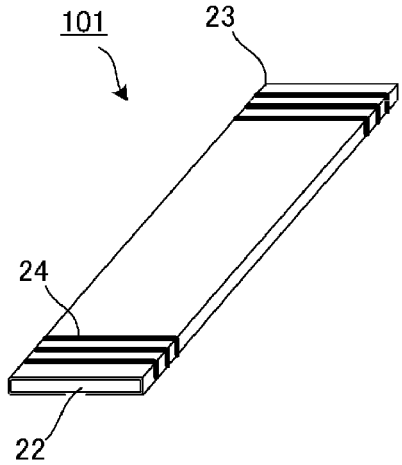

FIGS. 2A to 2C show a structure of a magnetic antenna 101 according to a first preferred embodiment of the present invention. FIG. 2A shows a perspective view of a flexible substrate, in a developed state, used in the magnetic antenna 101. FIG. 2B shows a perspective view of a magnetic core and the flexible substrate, in a folded state, used in the magnetic antenna 101. FIG. 2C shows a perspective view of the magnetic antenna 101.

Referring to FIGS. 2A to 2C, the magnetic antenna 101 includes a flexible substrate 23 having a coil conductor 24 provided thereon, and a magnetic core 22. On the flexible substrate 23, the coil conductor 24 preferably has a substantially rectangular spiral shape, where the center portion of the winding of the coil conductor 24 is formed as a conductor opening CW. In other words, the substantially-spiral-shaped coil conductor 24 is arranged so as to surround the conductor opening CW.

Referring to FIG. 2A, the four two-dot chain lines denote lines along which the flexible substrate 23 is to be bent. Referring to FIGS. 2B to 2C, the flexible substrate 23 is bent toward the magnetic core 22 along the two-dot chain lines and arranged so as to wrap around the upper surface, left and right surfaces, and portions of the lower surface of the magnetic core 22.

The magnetic core 22 preferably has a substantially rectangular plate shape, i.e., a plate provided with at least two parallel or substantially parallel sides. The flexible substrate 23 is bent in the vicinity of the two sides of the coil conductor 24 spaced apart from the center of the conductor opening CW and along the two sides of the magnetic core 22.

By using this structure, magnetic flux passing through the magnetic core 22 in a direction substantially perpendicular to the main surfaces thereof passes through the inside of the coil loop of the coil conductor 24, thereby increasing magnetic flux radiation efficiency. Since the two sides of the coil conductor 24 are arranged near the two sides of the magnetic core 22, the coil conductor 24 does not occupy considerable or significant portions of the magnetic-flux-passing surface of the magnetic core 22, thus ensuring a wide opening area of the antenna. This results in significant increases in the magnetic flux radiation efficiency, antenna sensitivity, and communication range.

Both ends of the coil conductor 24 shown in FIG. 2A are coil conductor connection portions, and the magnetic antenna 101 is mounted on a circuit substrate such that these coil conductor connection portions are electrically connected to electrodes on the circuit substrate. In this manner, an antenna device is configured which includes a conductor (ground pattern) located on a circuit substrate and the magnetic antenna 101, in a state in which the magnetic antenna 101 is mounted on the circuit substrate.

Second Preferred Embodiment

Figure 3A:
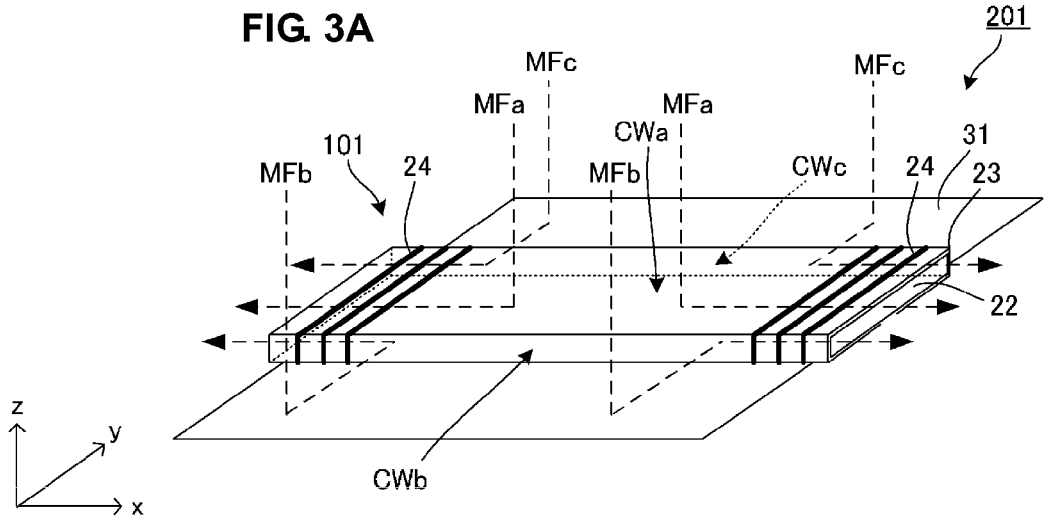
Figure 3B:
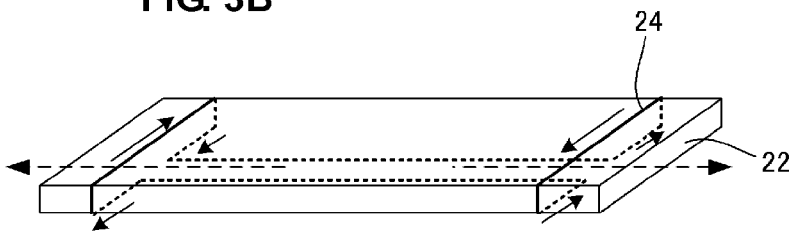

FIGS. 3A and 3B show a structure of a magnetic antenna 101 and an antenna device 201 according to a second preferred embodiment of the present invention. FIG. 3A shows a perspective view of the antenna device 201 and FIG. 3B illustrates a current that flows in the coil conductor of the magnetic antenna 101 and magnetic flux that passes through a magnetic core.

Referring to FIG. 3A, the antenna device 201 is configured by mounting the magnetic antenna 101 on a metal plate 31. The metal plate 31 is, for example, a conductor (ground pattern) disposed on a circuit substrate. The metal plate 31 corresponds to a "plate member having a sheet-shaped conductor" according to a preferred embodiment of the present invention.

Referring to FIG. 3A, the dotted lines represent major magnetic paths. By providing the magnetic antenna 101 on the metal plate 31 that does not allow passage of magnetic flux therethrough, magnetic paths are provided along which magnetic flux MFa substantially perpendicular to the metal plate 31 enters the magnetic core 22 through an opening CWa of the coil conductor 24 and leaves the magnetic core 22 through the left or right end thereof. Similarly, magnetic paths are provided along which magnetic flux MFb substantially perpendicular to the metal plate 31 enters the magnetic core 22 through an opening CWb of the coil conductor 24 and leaves the magnetic core 22 through the left or right end thereof. Likewise, magnetic paths are arranged along which magnetic flux MFc substantially perpendicular to the metal plate 31 enters the magnetic core 22 through an opening CWc of the coil conductor 24 and leaves the magnetic core 22 through the left or right end thereof.

FIG. 3B shows a relationship between magnetic flux passing through the magnetic core 22 and a current flowing through the coil conductor 24. Here, the coil conductor 24 is assumed to be made up of a single turn to simplify the drawing. As shown in this figure, when magnetic flux passes through the magnetic core 22 from the center to the left or right end thereof, the magnetic flux passes through the inside of the coil loop of the coil conductor 24, thereby generating electromotive force. Hence, electromotive force is generated when magnetic flux MFa, MFb, or MFc passes through the magnetic core 22 as shown in FIG. 2A.

Figure 4:
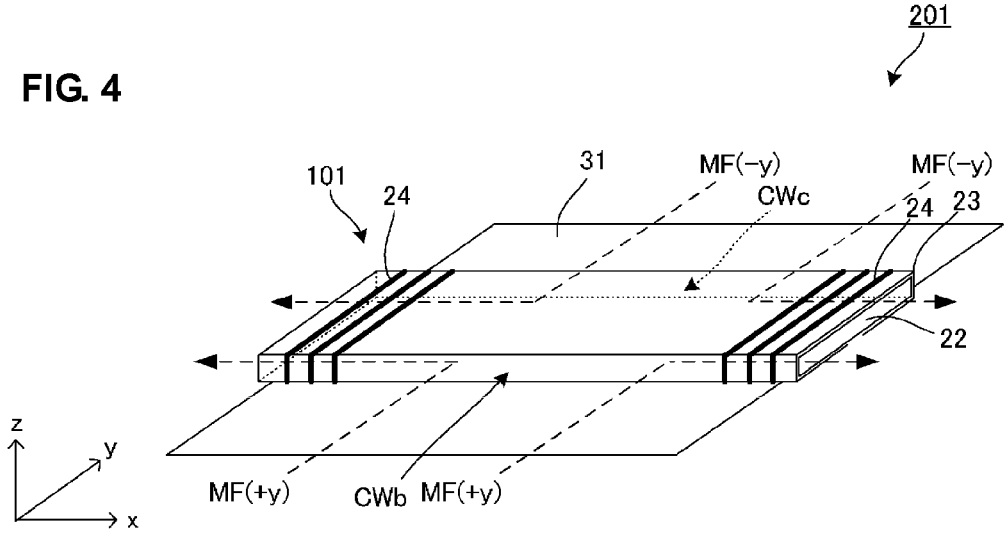
FIG. 4 is a diagram illustrating how magnetic paths are formed when magnetic flux is oriented, with respect to an antenna device, in a direction substantially parallel with the surface of the metal plate.

FIG. 4 shows how magnetic paths are formed when magnetic flux is oriented, with respect to an antenna device 201, in a direction substantially parallel with the surface of the metal plate 31. When magnetic flux MF(+y) is present in the direction +y, which is substantially parallel with the surface of the metal plate 31, magnetic paths are formed, as shown by the dotted lines in FIG. 4, that enter the magnetic core 22 through the opening CWb of the coil conductor 24 and leave the magnetic core 22 through the left and right ends thereof. Similarly, when magnetic flux MF(−y) is in the direction −y, which is substantially parallel with the surface of the metal plate 31, magnetic paths are formed, as shown by the dotted lines in FIG. 4, that enter the magnetic core 22 through the opening CWc of the coil conductor 24 and leave the magnetic core 22 through the left and right ends thereof.

These magnetic paths have no directional property. Hence, when magnetic flux is in the x direction, the magnetic flux enters the magnetic core 22 through the left or right end thereof and leaves the magnetic core 22 through the opening CWb or CWc of the coil conductor 24.

Note that there exists a magnetic flux component passing straight through the magnetic antenna 101 in the x or y direction; however, this magnetic flux component does not contribute to generation of electromotive force in the coil conductor 24.

In this manner, an antenna device is realized that has high sensitivity for magnetic flux not only in the z direction but also in the x and y directions shown in FIG. 3A.

Other than the above-described circuit substrate, by arranging a magnetic antenna on, for example, a shield plate provided on the backside of a liquid crystal display panel, an antenna device may be configured to include this shield plate and the magnetic antenna.

Third Preferred Embodiment

Figure 5A:
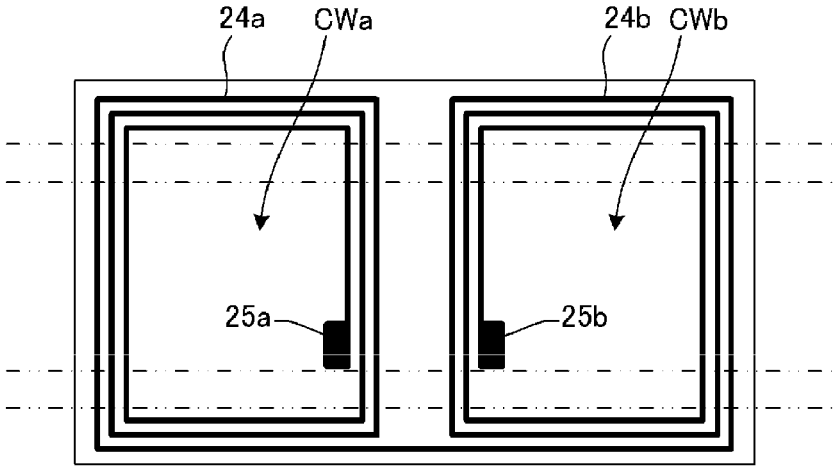
Figure 5B:
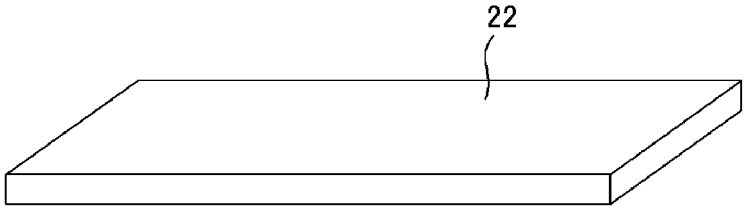
Figure 5C:
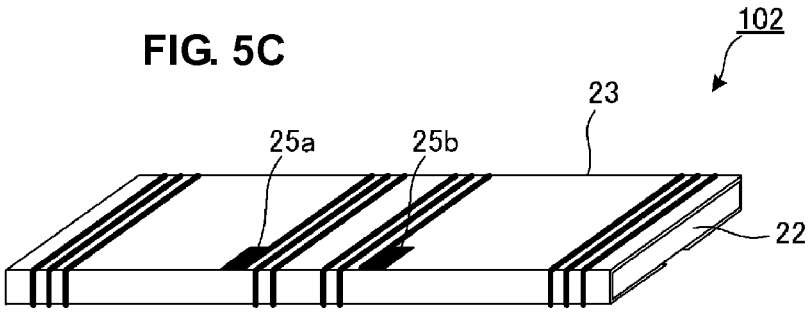

FIGS. 5A to 5C show a structure of a magnetic antenna 102 according to a third preferred embodiment of the present preferred embodiment. FIG. 5A shows a developed view of a flexible substrate used in the magnetic antenna 102. FIG. 5B shows a perspective view of a magnetic core 22 used in the magnetic antenna 102. FIG. 5C shows a perspective view of the magnetic antenna 102.

In the magnetic antenna 102 according to the third preferred embodiment, two coil conductors 24*a* and 24*b* each shaped like a substantially rectangular spiral are provided on the flexible substrate 23. The two coil conductors 24*a* and 24*b* have opposite winding directions and are serially connected to each other on the flexible substrate 23. The two coil conductors 24*a* and 24*b* have respective connection portions 25*a* and 25*b* of the coil conductors provided at the respective inner ends thereof.

The four two-dot chain lines shown in FIG. 5A denote lines along which the flexible substrate 23 is to be bent. The flexible substrate 23 is bent in the vicinity of the two sides of the coil conductors 24*a* and 24*b* spaced apart from the centers of the conductor openings CWa and CWb and along the two sides of the magnetic core 22.

By using this structure, magnetic flux passing through the magnetic core 22 in a direction substantially perpendicular to the main surfaces thereof passes through the insides of the coil loops of the coil conductors 24*a* and 24*b*, thereby increasing magnetic flux radiation efficiency. Since the respective two sides of the coil conductors 24*a* and 24*b* are arranged near the two sides of the magnetic core 22, the coil conductors 24*a* and 24*b* do not occupy considerable portions of the magnetic-flux-passing surface of the magnetic core 22, ensuring a wide opening area of the antenna. This results in significant increases in the magnetic flux radiation efficiency, antenna sensitivity, and communication range.

When the magnetic antenna 102 is brought near a metal plate as shown in FIG. 3A of the second preferred embodiment, the magnetic paths shown in FIG. 3A and FIG. 4 are provided, whereby advantages similar to that of the second preferred embodiment is provided.

In the example shown in FIGS. 5A to 5C, the connection pattern of the two coil conductors 24*a* and 24*b* becomes simple, and no insulation between wiring lines is required. Hence, there is no need to serially connect the two coil conductors 24*a* and 24*b* on a circuit substrate on which they are mounted. When the two coil conductors are to be connected in parallel, or when they are to be connected serially or in parallel on a substrate on which they are mounted, the two coil conductors need only be connected such that electromotive force generated due to magnetic flux passing through the coil loop of the first coil conductor has the same direction as that generated in the second coil conductor. Hence, the two coil conductors may be configured to have either the same winding direction or opposite winding directions.

Using two coil conductors in this manner allows the antenna to be designed so as to support a wide range of impedance by appropriately selecting the method (serial/parallel) used to connect the two coil conductors.

In the preferred embodiments described above, the flexible substrate is arranged so as to wrap around three surfaces of the magnetic core, by being bent by about 90 degrees along four lines. However, the flexible substrate may be arranged so as to wrap around the magnetic core by being curved instead of being bent by about 90 degrees, for example.

Fourth Preferred Embodiment

Figure 6A:
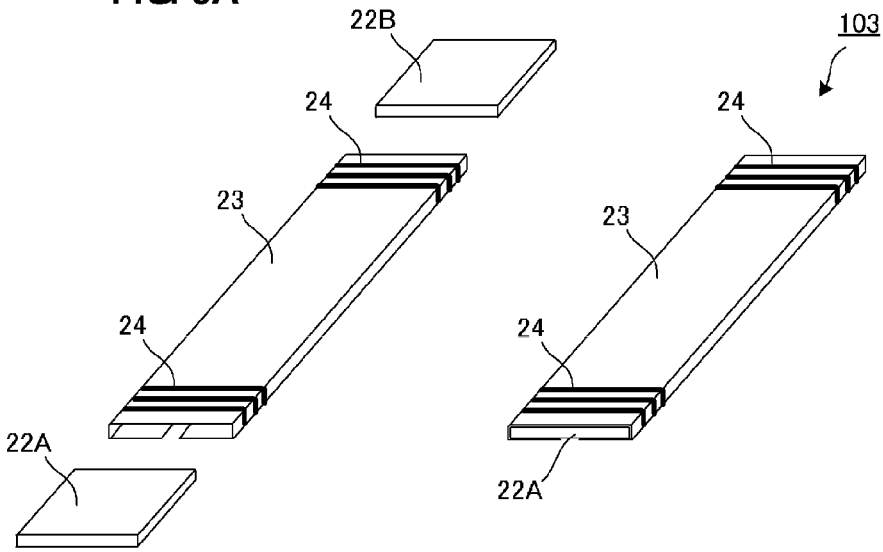
Figure 6B:
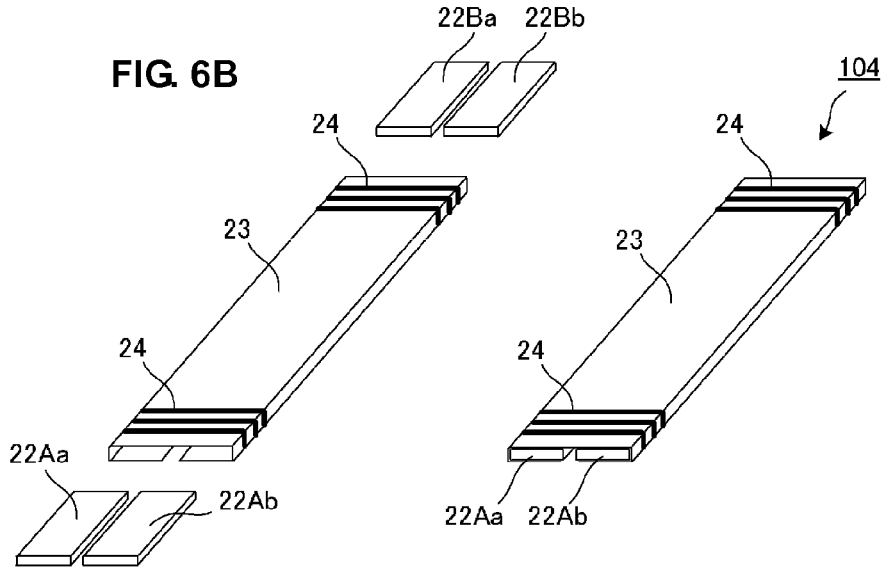

FIGS. 6A and 6B show structures of magnetic antennas 103 and 104 according to a fourth preferred embodiment of the present preferred embodiment. FIG. 6A shows a perspective view and an exploded perspective view of the magnetic antenna 103. FIG. 6B shows a perspective view and an exploded perspective view of the magnetic antenna 104.

Referring to FIG. 6A, the magnetic antenna 103 includes a flexible substrate 23 having a coil conductor 24 disposed thereon and two magnetic cores 22A and 22B. The two magnetic cores 22A and 22B are arranged at the positions of the winding portions of the coil conductor 24 on the flexible substrate 23. The flexible substrate 23 and the pattern of the coil conductor 24 formed thereon are similar to those shown in FIG. 2A.

By splitting the magnetic core into two parts and arranging them only in the required positions in this manner, the shock tolerance of the magnetic cores 22A and 22B is increased, while the function of providing magnetic paths is maintained. Further, the volume and weight of the magnetic core are reduced.

FIG. 6B shows an example in which each of the magnetic cores arranged in the end portions of the flexible substrate 23 is further split into two parts. Here, magnetic cores 22Aa and 22Ab at one end are arranged next to each other as a pair with a small gap therebetween. Magnetic cores 22Ba and 22Bb at the other end are also arranged next to each other as a pair with a small gap therebetween.

By splitting the magnetic core into a total of four parts, the shock tolerance of the magnetic cores 22Aa, 22Ab, 22Ba, and 22Bb is further increased.

Note that in order to prevent the pair of magnetic cores 22Aa and 22Ab arranged next to each other and the pair of magnetic cores 22Ba and 22Bb arranged next to each other from contacting each other within a pair due to a shock from falling, for example, soft spacers may be inserted between the magnetic cores 22Aa and 22Ab, and between the magnetic cores 22Ba and 22Bb. Alternatively, the magnetic cores

22Aa, 22Ab, 22Ba, and 22Bb may be bonded to the flexible substrate 23 or a circuit substrate on which they are mounted.

Fifth Preferred Embodiment

Figure 7A:
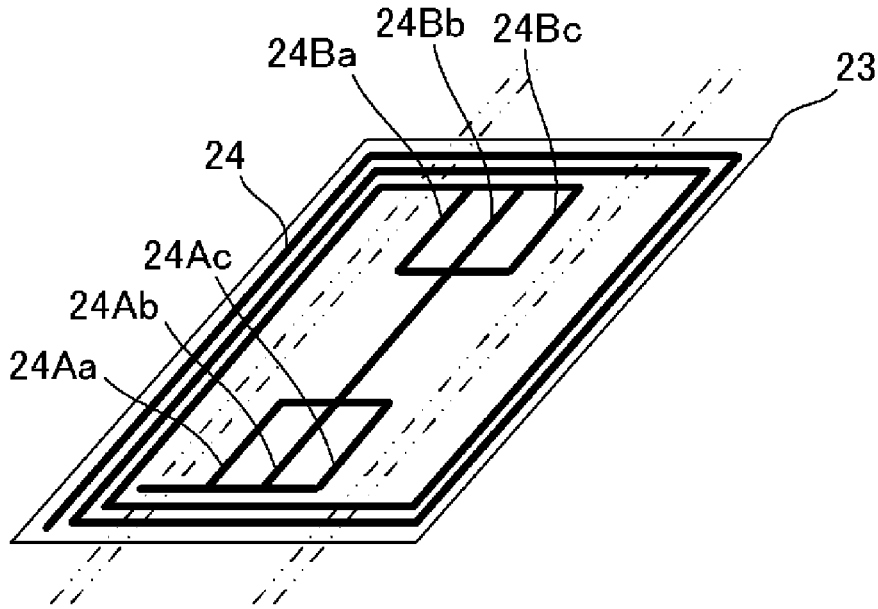
Figure 7B:
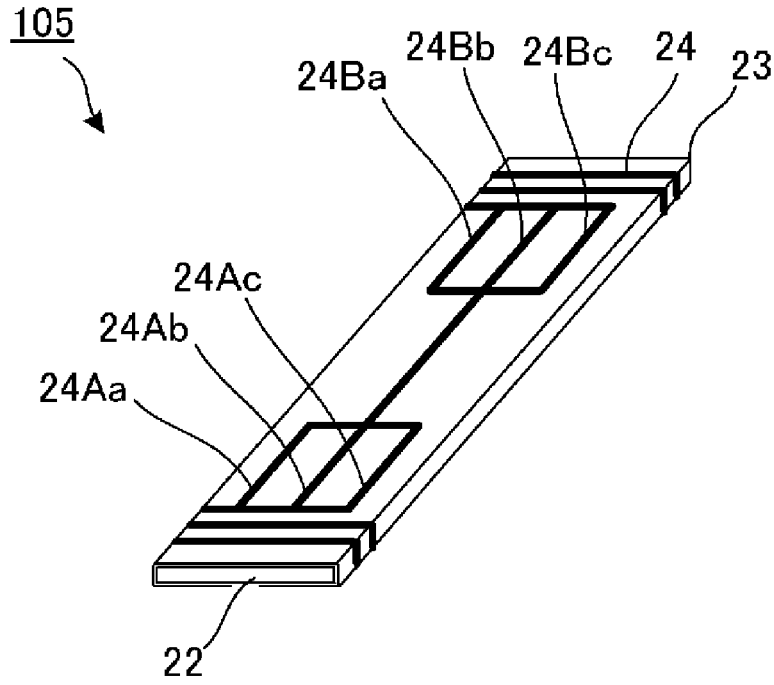

FIGS. 7A and 7B show a structure of a magnetic antenna 105. FIG. 7A shows a perspective view of a flexible substrate, in a developed state, used in the magnetic antenna 105. FIG. 7B shows a perspective view of the magnetic antenna 105.

Referring to FIGS. 7A and 7B, the magnetic antenna 105 includes a flexible substrate 23 having a coil conductor 24 formed thereon, and a magnetic core 22. A generally and substantially rectangular spiral coil 24 and coil conductor patterns 24Aa, 24Ab, 24Ac, 24Ba, 24Bb, and 24Bc are provided on the flexible substrate 23 to provide inductance adjustment.

The four two-dot chain lines in FIG. 7A denote lines along which the flexible substrate 23 is to be bent. Referring to FIG. 7B, the flexible substrate 23 is bent toward the magnetic core 22 along the two-dot chain lines and arranged so as to wrap around the upper surface, left and right surfaces, and portions of the lower surface of the magnetic core 22.

This configuration makes it possible to adjust the inductance value of the magnetic antenna 105 to a predetermined value by trimming, using a laser, for example, a predetermined one or more of the coil conductor patterns 24Aa, 24Ab, 24Ac, 24Ba, 24Bb, and 24Bc for inductance adjustment.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device comprising:

a magnetic antenna including:

a magnetic core;

a flexible substrate arranged to wrap around the magnetic core along a surface thereof; and a coil conductor on the flexible substrate; wherein the magnetic core has a substantially plate-shaped configuration including at least two substantially parallel side surfaces, a first main surface, and a second main surface substantially parallel to the first main surface, the at least two substantially parallel side surfaces extending between and connecting the first and second main surfaces;

the coil conductor has a single spiral shape including at least two substantially parallel sides and only a single conductor opening located at a winding center of the coil conductor; and the flexible substrate is bent such that the winding center of the coil conductor is located on the first main surface of the magnetic core, so as to wrap around the magnetic core from the first main surface through two different side surfaces of the at least two substantially parallel side surfaces to the second main surface of the magnetic core, and such that two of the at least two parallel sides of the coil conductor are located on the second main surface of the magnetic core; and a plate member including a sheet-shaped conductor provided in a vicinity of the magnetic antenna; wherein the second main surface of the magnetic core faces a main surface of the plate member.

2. The antenna device according to claim 1, further comprising another coil conductor disposed on the flexible substrate and having a single spiral shape.

3. The antenna device according to claim 2, wherein the coil conductors and the another coil conductor have opposite winding directions and are serially connected to each other.

* * * * *